United States Patent [19]

Abel et al.

[11] 4,123,378

[45] Oct. 31, 1978

[54] STAIN REMOVING AGENTS AND PROCESS FOR CLEANING AND OPTIONALLY DYEING TEXTILE MATERIAL

[75] Inventors: Heinz Abel; Alfred Berger, both of Reinach, Switzerland

[73] Assignee: Ciba-Geigy AG, Basel, Switzerland

[21] Appl. No.: 717,976

[22] Filed: Aug. 26, 1976

[30] Foreign Application Priority Data

Sep. 16, 1975 [CH] Switzerland ..... 12011/75
Apr. 30, 1976 [CH] Switzerland ..... 5448/76

[51] Int. Cl.[2] ..... C11D 1/22; C11D 1/29; C11D 3/43; D06P 5/00

[52] U.S. Cl. ..... 252/171; 8/17; 8/137; 8/138; 8/139; 252/89 R; 252/17 D; 252/173; 252/541; 252/551; 252/559; 252/DIG. 14

[58] Field of Search ..... 252/89, 118, 122, 532, 252/540, 551, 559, 171, 173, DIG. 1, DIG. 14

[56] References Cited

U.S. PATENT DOCUMENTS

| | | | |
|---|---|---|---|
| 1,920,987 | 12/1932 | Kaltenbach | 8/6 |
| 2,730,503 | 1/1956 | Pressner | 252/543 |
| 2,746,932 | 5/1956 | Vitale | 252/540 |
| 2,855,367 | 10/1958 | Buck | 252/540 |
| 2,918,428 | 12/1959 | Hunter | 252/8.75 |
| 3,285,856 | 11/1966 | Lew | 252/171 |
| 3,634,264 | 1/1972 | Pence | 252/106 |
| 3,650,965 | 3/1972 | Cantor | 252/106 |
| 3,703,472 | 11/1972 | Shaw | 252/107 |
| 3,812,041 | 5/1974 | Inamorato | 252/89 |
| 3,900,407 | 8/1975 | Kaufman | 8/137 X |
| 3,928,249 | 12/1975 | Nunziata | 252/526 |
| 3,969,258 | 7/1976 | Carandang | 252/106 |

FOREIGN PATENT DOCUMENTS

| | | | |
|---|---|---|---|
| 244,835 | 1/1963 | Australia | 252/559 |
| 1,062,867 | 8/1959 | Fed. Rep. of Germany | 252/171 |
| 547,694 | 12/1922 | France | 252/122 |
| 1,122,759 | 9/1956 | France | 8/82 |
| 1,472,561 | 3/1967 | France | 252/551 |
| 808,805 | 2/1959 | United Kingdom | 252/551 |
| 842,813 | 7/1960 | United Kingdom | 252/121 |
| 1,008,697 | 11/1965 | United Kingdom | 252/540 |

*Primary Examiner*—Dennis L. Albrecht
*Attorney, Agent, or Firm*—Burgess, Dinklage & Sprung

[57] ABSTRACT

New stable stain removing compositions are provided which contain 15 to 35 percent by weight of an anionic surfactant, optionally 3 to 25 percent by weight of a water-insoluble alcohol containing 8 to 18 carbon atoms, 3 to 25 percent by weight of pine oil, of a reaction product of a fatty acid containing 8 to 18 carbon atoms and sorbitol, and/or of at least one alkylene oxide adduct of the formula $RO(CH_2CHR_1O)_nH$ or of an ester of the formula $Z'COOR_2$, wherein R is an aliphatic hydrocarbon radical of 12 to 18 carbon atoms, R' is an aliphatic hydrocarbon radical of 7 to 17 carbon atoms, $R_1$ is hydrogen or methyl, $R_2$ is $$-(CH_2\underset{\underset{R_1}{|}}{C}HO)_nH$$

or $-CH_2CHOHCH_2OH$, and *n* is an interger from 1 to 12, the amount of components (2) and (3) together being at least 12 percent by weight, and 30 to 73 percent by weight of water.

These agents provide excellent cleaning and dispersing power and are particularly adapted to use in cleaning or combined cleaning (washing) and dyeing processes.

5 Claims, No Drawings

STAIN REMOVING AGENTS AND PROCESS FOR CLEANING AND OPTIONALLY DYEING TEXTILE MATERIAL

It is known to clean textile material carefully before dyeing it in order to remove for example sizing agents, spinning oils or lubricants, and also natural fats, for example wool fat, or other impurities, since these can hamper a uniform and level colouration of the textile material. This preliminary cleaning can be carried out for example in organic solvents or preferably in aqueous wash liquors which contain the conventional detergents. The textile material is subsequently rinsed and only then put into a dyebath and dyed.

It has already been proposed to combine these very wasteful energy-, water- and time-consuming procedures, namely to carry them out in one liquor, if appropriate in a number of steps.

In doing so, however, it became apparent that, under dyeing conditions, the detergents possessed various disadvantages which had an unfavourable effect on the dyeings.

For example, the surfactants contained in conventional detergents normally have too low a cleaning strength under the operating conditions and concentrations described hereinafter to achieve the desired cleaning effect. The cloud point of many of these surfactants is in the range of the dyeing temperatures, so that the stability of the dyebath is no longer ensured and unlevel dyeings of poor fastness to rubbing are obtained. In addition, the surfactants can have a retarding and blocking action and thus adversely affect the exhaustion of the dye onto the fibres and also the dye yield on the fibres.

The possible use of soaps which have a sufficient washing and cleaning strength is ruled out to the extent that they are sensitive to electrolytes and are therefore particularly unstable to acids.

The present invention has for its object to provide new stable assistant mixtures (stain removing agents), which can be used in cleaning or combined washing and dyeing processes. With the assistant mixture of the present invention it is possible to pretreat organic, natural and synthetic fibrous materials or mixtures thereof, in particular those areas of the material which are badly soiled, and subsequently to wash the material, or to wash and dye the fibrous material in a liquor which contains the assistant mixture in a single step or two-step process without an intermediate rinsing procedure.

The present invention provides stain removing agents which contain (1) 15 to 35 percent by weight of an anionic surfactant, (2) optionally 3 to 25 percent by weight of a water-insoluble alcohol containing 8 to 18 carbon atoms, (3) 3 to 25 percent by weight of pine oil, of a reaction product of a fatty acid containing 8 to 18 carbon atoms and sorbitol, and/or of at least one alkylene oxide adduct of the formula $$RO(\overset{\overset{R_1}{|}}{CH_2CH}O)_nH \qquad (1)$$

or of an ester of the formula (2) $R'COOR_2$, wherein R is an aliphatic hydrocarbon radical of 12 to 18 carbon atoms, R' is an aliphatic hydrocarbon radical of 7 to 17 carbon atoms, $R_1$ is hydrogen or methyl, $R_2$ is $$-(\overset{\overset{R_1}{|}}{CH_2CH}O)_nH$$

or $-CH_2CHOHCH_2OH$, and $n$ is an integer from 1 to 12, the amount of components (2) and (3) together being at least 12 percent by weight, and (4) 30 to 73 percent by weight of water.

Preferably the weight ratio of components (2) and (3) to each other is 7:1 to 1:7, but particularly 1:1.

Particularly suitable assistants are also those which contain (1) 15 to 35 percent by weight of an anionic surfactant, (2) optionally 3 to 25 percent by weight of a water-insoluble alcohol containing 8 to 18 carbon atoms, (3) 3 to 25 percent by weight of pine oil, the amount of components (2) and (3) together being at least 12 percent by weight and their weight ratio (7:1) to (1:7), and (4) 30 to 73 percent by weight of water.

It is a further object of the invention to provide a process for cleaning soiled natural or synthetic textile material by pretreating said material with the stain removing agents in places or, if appropriate, also completely, and subsequently washing it with conventional detergents in an aqueous wash liquor.

It is also an object of the invention to provide a process for washing and dyeing natural or synthetic textile material, which comprises the use of the agents of the present invention, both during the washing and during the dyeing procedure. The washing and dyeing process can be carried out simultaneously in one liquor (i.e. in a single step) or also in succession in the same liquor (i.e. in twosteps), without the necessity of an intermediate rinsing procedure between washing and dyeing.

Anionic surfactants of component (1) in the assistants of the present invention are, for example, adducts, containing acid groups of inorganic or organic acids, of ethylene oxide and/or propylene oxide and saturated or unsaturated fatty acids, higher alcohols, alicyclic alcohols and aliphatic-aromatic hydrocarbons.

Thus the surfactants of component (1) can be compounds of the formula $$R_3-A-(\overset{\overset{R_1}{|}}{CH_2CH}-O)_{n_1}-X \qquad (3)$$

wherein $R_3$ is an aliphatic hydrocarbon radical of 8 to 22 carbon atoms or a cycloaliphatic or aliphatic-aromatic hydrocarbon radical of 10 to 22 carbon atoms, $R_1$ is hydrogen or methyl, A is —O— or $$-\overset{\overset{O}{\|}}{C}-O,$$

X is the acid radical of an inorganic acid which contains oxygen or the radical of a carboxylic acid and $n_1$ is an integer from 1 to 50.

The radical $R_3$—A— is derived, for example, from higher alcohols, such as decyl, lauryl, tridecyl, myristyl, cetyl, stearyl, oleyl, arachidyl or behenyl alcohol; from hydroabietyl alcohol; from fatty acids, such as caprylic, capric, lauric, myristic, palmitic, stearic, arachidic, behenic acid, coconut fatty acid (8 to 18 carbon atoms), decenoic, dodecenoic, tetradecenoic, hexadecenoic, oleic, linoleic, linolenic, eicosenic, docosenic or clupanodonic acid; from alkylphenols, such as butyl-, hexyl-, n-octyl-, n-nonyl-, p-tert. octyl-, p-tert. nonyl-, decyl-, dodecyl-, or pentadecylphenol. Other possible contenders are for example octyl cresol, butyl cresol or 2,4-diamylphenol. Preferred radicals are those containing 10 to 18 carbon atoms, in particular those which are derived from the alkylphenols.

The acid radical X is derived as a rule from low molecular organic monocarboxylic or dicarboxylic acids, for example from chloroacetic acid, acetic acid, malonic acid, succinic acid or sulphosuccinic acid, and is attached to the radical $R—A—(CH_2CHR_1O)_{n_1}—$ through an ether or an ester bridge. In particular, however, X is derived from inorganic polyvalent acids, such as orthophosphoric acid and sulphuric acid. The acid radical X is preferaby in salt form, that is to say, for example, in the form of an alkali metal, ammonium or amine salt. Examples of such salts are sodium, potassium, ammonium, trimethylamine, ethanolamine, diethanolamine or triethanolamine salts. The alkylene oxide units $—(CH_2CHR_1O)_{n_1}—$ in formula (3) are normally ethylene oxide and 1,2-propylene oxide units, these latter being preferably in admixture with the ethylene oxide units in the compounds of the formula (3).

These compounds are obtained by known methods by reacting the above alcohols, acids and alkylphenols with ethylene oxide or in turn, in optional sequence, with ethylene oxide and 1,2-propylene oxide, and subsequently esterifying the reaction products and, if appropriate, converting the esters into their salts. Surfactants of component (1) are known, for example, from U.S. Pat. No. 3,211,514.

Surfactants of the formula (3), which are prepared by using ethylene oxide and 1,2-propylene oxide, have for example the formula $$R_3—A—(CH_2CH_2O)_{m_1}—(CH_2\underset{\underset{CH_3}{|}}{C}HO)_{m_2}—(CH_2CH_2O)_{m_3}—X, \quad (4)$$

wherein $R_3$, A and X are as previously defined, the sum of $m_1$, $m_2$ and $m_3$ is 2 to 20 and the ratio of ethylene oxide to propylene oxide groups in compounds of the formula (4) is 1:0 to 1:3, preferably 1:0 to 1:2 and, in particular, 1:0 to 1:1.

Preferred surfactants are those of the formula (3), which have the formula $$R_3—A—(CH_2CH_2O)_{n_1}—X \quad (5)$$

wherein $R_3$, A and X are as defined hereinbefore and $n_1$ is an integer from 1 to 50, preferably from 1 to 30.

Particularly preferred surfactants are also the anionic surfactants of the formula $$R_4O—(CH_2CH_2O)_{n_1}—X, \quad (6)$$

wherein $R_4$ is a saturated or unsaturated hydrocarbon radical or alkylphenyl of 10 to 18 carbon atoms and X and $n$ have the indicated meanings.

Particularly preferred surfactants which are derived from alkylphenol/ethylene oxide adducts are those of the formulae

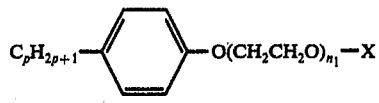

(7)

and

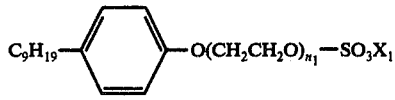

(8)

wherein $p$ is an integer from 8 to 12, $X_1$ is hydrogen, $NH_4$ or an alkali metal cation, and X and $n_1$ have the indicated meanings.

As optional component (2) there are used, for example, water-insoluble monoalcohols containing 8, preferably 8 to 18 or especially 8 to 9, carbon atoms. The alcohols can be saturated or unsaturated and branched or straight-chain and can be used by themselves or in admixture.

It is possible to use natural alcohols, for example myristyl alcohol, cetyl alcohol, stearyl alcohol or oleyl alcohol, or synthetic alcohols, such as 2-ethyl hexanol, trimethyl hexanol, octyl alcohol, nonyl alcohol, trimethylnonyl alcohol, or the Alfols (registered trademark, Continental Oil Company). The Alfols are linear primary alcohols. The number following the name indicates the average number of carbon atoms which the alcohol contains. For example, Alfol (1218) is a mixture of dodecyl, tetradecyl, hexadecyl and octadecyl alcohol. Other types are Alfol (810), (12), (16) and (18). The preferred component (2) is 2-ethylhexanol.

The pine oil of component (3) is a colourless to light yellow liquid which is insoluble in water and soluble in organic solvents. It is a product known to the skilled person and can be obtained for example by distilling the waste wood of various American pine species and contains at least 65% of terpene alcohols [Rompp, Chemie Lexikon, 3431 (1958)].

Alkylene oxide reaction products, such as the 1,2-propylene oxide reaction products, for example those which contain 1 to 12 moles of propylene oxide, but preferably ethylene oxide reaction products containing 1 to 12 ethylene oxide units in the molecule of alcohols containing 12 to 18 carbon atoms, can also be used as component (3). They can be illustrated for example by the following formula $$R_5O(CH_2CH_2O)_sH \quad (9)$$

wherein $R_5$ is a saturated or unsaturated aliphatic hydrocarbon radical, preferably an alkyl radical of 12 to 18, preferably 16 to 18, carbon atoms, and $s$ is an integer from 1 to approx. 8.

The compounds cited as component (2) can be used as alcohols for obtaining the alkylene oxide reaction products of component (3). Lauryl, cetyl or oleyl alcohol is preferably used.

The esterification products of the formula (2) and reaction products of fatty acids containing 8 to 18 carbon atoms and sorbitol are also possible for use as component (3). Examples of suitable acids which can be used for obtaining the esterification products of the formula (2) are: caprylic, capric, lauric, myristic, palmitic, stearic, coconut fatty, decenoic, dodecenoic, tetradecenoic, hexadecenoic, oleic, linoleic or linolenic acid. The products of component (3) are compounds which can be obtained by known processes with which the skilled person is familiar [addition of ethylene oxide and/or propylene oxide to fatty alcohols or fatty acids; reaction of polyethylene glycol or polypropylene glycol, or glycerol or sorbitol with fatty acids].

Preferably the esterification products of the formula (2) have the formula $$R_5—COOR_2, \quad (10)$$

wherein $R_5$ is a saturated or unsaturated aliphatic hydrocarbon radical of 11 to 17, preferably 15 to 17, carbon atoms, and $R_2$ is as previously defined. Preferred acid radicals are those of lauric, palmitic and stearic and oleic acid.

The assistants of the present invention can be obtained as homogeneous, preferably clear, mixtures, which are very stable when stored at room temperature, by simply stirring the above components in water at temperatures of 15° to 80° C., in particular at temperatures of 15° to 30° C.

The following table illustrates a number of suitable compositions of the agents according to this invention:

| | | | | | | | | |
|---|---|---|---|---|---|---|---|---|
| component (1): | 17 | 20 | 23 | 24 | 26 | 26 | 28 | 30 |
| component (2): | 9 | 10 | 7 | 13 | 3 | 21 | 10 | 15 |
| component (3): | 4 | 10 | 7 | 13 | 21 | 3 | 10 | 15 |
| water : | 67 | 60 | 54 | 50 | 50 | 50 | 52 | 40. |

The agents according to the invention which contain components (1) to (3) and water in the following amounts may be regarded as most particularly suitable:

20 to 30 percent by weight of component (1),
6 to 20 percent by weight of component (2),
6 to 20 percent by weight of component (3) and
40 to 68 percent by weight of water.

Depending on the amount and nature of the components used, the agents of the present invention are of slight to high viscosity and, surprisingly, are miscible with water in any ratio to yield immediately homogeneous, clear or emulsified (pasty) preparations. If appropriate, the agents of the invention can also be in concentrated form, i.e. containing no water [component (4)]. Before application they can then be diluted with water in an amount sufficient to attain the ratios of the individual components indicated for the agents. It will be readily understood that an improved pourability of the preparations is simultaneously also attained. The agents facilitate the preparation of stable application liquors, for example wash liquors and dyebaths, since it is possible to work with ready-made assistant mixtures and it is not necessary to add each of the components individually to the application bath. The agents of the present invention can be used in acid or alkaline preparations (pH range approx. 1 to 12, preferably 2 to 10) without losing their activity.

They have almost no affinity for fibres or dyes and exhibit a very good detergent action also under those conditions which exist during dyeing, for example in boiling acid dyebaths. The agents have no cloud point, so that the dyeings suffer no adverse effects which are attributable to an instability of the dyebath.

The agents of this invention can be used for washing and dyeing textile material made of any organic, natural or synthetic fibres.

Examples of suitable organic fibres are: natural polyamide fibres, such as silk or preferably wool; synthetic polyamide fibres, in particular of poly(hexamethylene adipic acid amide) (nylon 66), poly(ε-caprolactam) (nylon 6), poly(hexamethylenesebacic acid amide) (nylon 610) or poly(11-aminoundecanoic acid) (nylon 11); cellulosic fibres, such as linen or cotton, and regenerated cellulose, such as rayon or viscose staple fibre; polyacrylonitrile fibres and fibres of copolymers of acrylonitrile and other vinyl compounds, such as acrylic esters, acrylic amides, vinyl pyridine, vinyl chloride or vinylidene chloride, copolymers of dicyanoethylene and vinyl acetate and of acrylonitrile block copolymers (modacrylic fibres); polyester fibres, such as polyethylene glycol terephthalate fibres, polyolefin fibres, such as polypropylene fibres, and fibre blends, for example wool/polyester, wool/cotton, cotton/polyester.

These fibres can be in any stage of processing, for example in the form of filaments, yarns, wovens and knits and piece goods, or — if the material is wool or silk — also in loose form, if they are cleaned (washed) and dyed in the presence of the agents of the invention.

The application of the agents of the present invention can be effected direct in the dyebath (single bath), but preferably in a separate pretreatment (two-stage). The pretreatment is normally carried out as padding process by impregnating the substrates with aqueous, organic-aqueous or organic preparations which contain the agents of the invention, squeezing the substrates out to a pick-up of 60 to 140% and, if appropriate, storing them with the exclusion of air, before carrying out the actual dyeing process in aqueous or organic liquors by conventional methods without the necessity of an intermediate rinsing procedure. Solvents for the organic liquors are in particular chlorinated hydrocarbons, preferably perchloroethylene and trichloroethylene. The impregnating process is preferred, since the pretreatment can be carried out with relatively highly concentrated liquors. The amount of agents used can thus be kept relatively low. The liquors contain for example 10 to 500 parts by weight (1 to 50 percent by weight) of the agent of the invention and 990 to 500 parts by weight of water or —especially in organic solvent liquors — the given amounts of agent per liter of liquor. The cleaning or washing processes are preferably carried out at room temperature (15° to 30° C.), but can also be carried out at more elevated temperatures. Thereafter the substrates are stored optionally for 15 minutes to 24 hours with the exclusion of air. If the application is effected in the dyebath, this latter can contain from 1 to 10 percent by weight of the agent according to the invention, referred to the substrate to be treated.

For the process for cleaning soiled textile material, which can be both dyed or undyed, the agents of the present invention are normally applied not from aqueous or organic liquors, but as a mixture of the cited components (1) to (4). By adding water, and optionally with the further addition of thickeners or binders, the viscosity of the cleaning agents can be so adjusted that it is possible to obtain, for example, both liquid emulsions and highly viscous pastes. By applying the stain removing agents to parts or to the entire surface of the textile material (pretreatment), dirt and oil stains for example can be removed more easily and more completely in a subsequent washing procedure.

If appropriate, the stain removing agents can also be used for cleaning wood, metal, plastic or glass surface.

The textile material can be dyed by known methods and the dyeing preparations contain the agents of this invention, with or without further conventional assistants, such as levelling agents, salts, acids, thickeners, carriers. The following dyeing processes may be cited as examples: dyeing wool with 1:1 or 1:2 metal complex dyes, acid or reactive dyes; exhaustion or continuous process for dyeing synthetic polyamide fibres with acid dyes or disperse dyes; dyeing polyester fibres with disperse dyes by the high temperature process; dyeing cellulosic fibres with reactive and direct exhausting dyes; dyeing polyacrylonitrile fibres with reactive and direct exhausting dyes; dyeing polyacrylonitrile fibres with cationic dyes; or dyeing blended fabrics with the dyes suitable for them.

The agents of the present invention promote the levelness of the dyeings, for example in the non-barry dyeing of synthetic polyamide fibre material or in dyeing textile material of polyester fibres by the high temperature process, by substantially preventing the deposit of oligomers on the fibrous material, and in addition they impart to the textile material a pleasing and soft handle.

In the following Examples the parts and percentages are by weight unless otherwise indicated. The following reaction products or compounds for components (1), (2) and (3) are mentioned in the Examples: Component (1) (Anionic surfactants):

$A_1$: ammonium salt of the acid sulphuric acid ester of the adduct of 2 moles of ethylene oxide and 1 mole of p-tert. nonylphenol;

$A_2$: ammonium salt of the acid sulphuric acid ester of the adduct of 50 moles of ethylene oxide and 1 mole of p-nonylphenol;

$A_3$: ammonium salt of the acid sulphuric acid ester of the adduct of 3 moles of ethylene oxide and 1 mole of tridecyl alcohol;

$A_4$: ammonium salt of the acid sulphuric acid ester of the adduct of 3 moles of ethylene oxide and 1 mole of p-butylphenol;

$A_5$: ammonium salt of the acid phosphoric acid ester of the adduct of 2 moles of ethylene oxide and 1 mole of p-nonylphenol;

$A_6$: sodium salt of the acetate of the adduct of 4 moles of ethylene oxide and 1 mole of p-octylphenol;

$A_7$: sodium salt of the disulphosuccinic acid ester of the adduct of 4 moles of ethylene oxide and 1 mole of p-octylphenol;

$A_8$: ammonium salt of the acid sulphuric acid ester of coconut fatty acid diglycol;

$A_9$: ammonium salt of the acid sulphuric acid ester of the adduct of 1 mole of ethylene oxide and 1 mole of stearyl alcohol;

$A_{10}$: ammonium salt of the acid sulphuric acid ester of the adduct of 9 moles of ethylene oxide and 1 mole of p-nonylphenol;

$A_{11}$: ammonium salt of the acid sulphuric acid ester of the adduct of 6 moles of ethylene oxide and 1 mole of p-nonylphenol;

$A_{12}$: sodium salt of the monosulphosuccinic acid ester of the adduct of 2 moles of ethylene oxide and 1 mole of p-nonylphenol;

$A_{13}$: ammonium salt of the acid sulphuric acid ester of the adduct of 20 moles of ethylene oxide and 1 mole of stearyl alcohol;

$A_{14}$: ammonium salt of the acid sulphuric acid ester of the adduct of 10 moles of ethylene oxide and 1 mole of dodecyl alcohol;

$A_{15}$: ammonium salt of the acid sulphuric acid ester of the adduct of 1 mole of propylene oxide and 1 mole of ethylene oxide and 1 mole of nonylphenol;

$A_{16}$: ammonium salt of the acid sulphuric acid ester of the adduct of 10 moles of propylene oxide and 10 moles of ethylene oxide and 1 mole of nonylphenol;

$A_{17}$: ammonium salt of the acid sulphuric acid ester of the adduct of 6 moles of ethylene oxide and 1 mole of pentadecylphenol;

$A_{18}$: ammonium salt of the acid sulphuric acid ester of the adduct of 5 moles of ethylene oxide and 1 mole of tributylphenol;

$A_{19}$: ammonium salt of the acid sulphuric acid ester of the adduct of 3 moles of ethylene oxide and Alfol (2022).

Component (2):

$B_1$: 2-ethylhexanol;

$B_2$: Alfol (1218);

$B_3$: trimethylhexanol;

$B_4$: octyl alcohol;

$B_5$: nonyl alcohol;

Component (3):

$C_1$: adduct of 2 moles of ethylene oxide and 1 mole of lauryl alcohol;

$C_2$: adduct of 4 moles of ethylene oxide and 1 mole of cetyl alcohol;

$C_3$: adduct of 5 moles of ethylene oxide and 1 mole of oleyl alcohol;

$C_4$: adduct of 8 moles of ethylene oxide and 1 mole of oleyl alcohol;

$C_5$: adduct of 1 mole of ethylene oxide and 1 mole of oleyl alcohol;

$C_6$: adduct of 3 moles of propylene oxide and 1 mole of oleyl alcohol;

$C_7$: adduct of 3 moles of propylene oxide and 4 moles of ethylene oxide and 1 mole of oleyl alcohol;

$C_8$: oleic acid dipropylene glycol ester;

$C_9$: oleic acid triethylene glycol ester;

$C_{10}$: oleic acid polyethylene glycol ester (molecular weight of the polyethylene glycol 300);

$C_{11}$: adduct of 12 moles of ethylene oxide and 1 mole of oleic acid;

$C_{12}$: coconut fatty acid polyethylene glycol ester (molecular weight of the polyethylene glycol 200);

$C_{13}$: glycerol monostearate;

$C_{14}$: lauric acid sorbitol ester;

$C_{15}$: palmitic acid sorbitol ester;

$C_{16}$: adduct of 10 moles of ethylene oxide and 1 mole of stearyl alcohol;

$C_{17}$: adduct of 11 moles of ethylene oxide and 1 mole of oleyl alcohol.

EXAMPLE 1

24 Parts of surfactant $A_1$, 10 parts of compound $B_1$, 16 parts of pine oil and 45 parts of water are mixed together at room temperature and then the mixture is diluted with water to 1000 parts by volume.

A knitted fabric of texturised polyester fibres is padded with this liquor and squeezed out to a pick-up of 90%. After it has been padded, the fabric is rolled up and stored in a polyethylene sheet for 12 hours with the exclusion of air. Without any intermediate rinsing procedure, the goods are subsequently dyed for 1 hour at 135° C. in a jet dyeing machine in a liquor which contains 4% of the dye of the formula

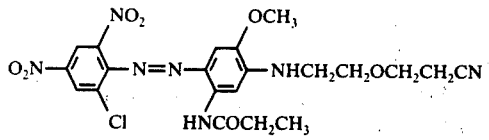

(101)

and 1 g/l of a condensation product of naphthaline sulphonic acid and formaldehyde. The percentage figure cited above refers to the weight of the goods. The fabric is then thoroughly rinsed and, if appropriate, subjected to a reductive aftertreatment. A level, navy blue dyeing which is fast to rubbing is obtained. The methylene chloride extract of the fibrous material used contains 4.3% and after padding and dyeing 0.6% solids content (referred to the textile material). Good results are also obtained by using surfactants $A_2$ to $A_{19}$ instead of surfactant $A_1$ and compounds $B_2$ to $B_5$ instead of compound $B_1$.

If the material is dyed without the preliminary cleaning described above, the dye yield is lower and the fastness to rubbing poorer. If the material is cleaned beforehand with chlorinated hydrocarbons in the conventional manner instead of being treated as described above, then a portion of the solvent is retained by the fibres, resulting in an increased oligomer deposit during dyeing and in dyeings of poor fastness to rubbing.

EXAMPLE 2

20 Parts of surfactant $A_1$, 9 parts of compound $B_1$, 4 parts of pine oil and 67 parts of water are mixed together at room temperature and the mixture is diluted with water to 1000 parts by volume. A woollen fabric is padded with this liquor and squeezed out to a pick-up of 80%. The fabric is then wound onto a beam dyeing machine and dyed for 1 hour at the boiling temperature of the dyebath, which contains 4% of the dye of the formula

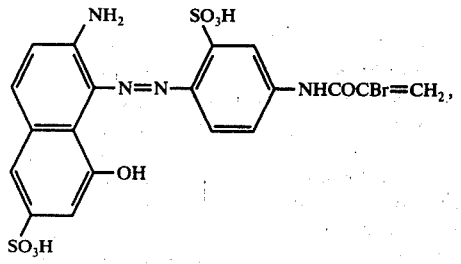

(102)

1% of a reaction product of 1 mole of a fatty amine ($C_{16}$–$C_{18}$) and 7 moles of ethylene oxide, quaternised with chloroacetamide (54% aqueous solution), 1% of the ammonium salt of the acid sulphuric acid ester of the reaction product of 1 mole of a fatty amine and 7 moles of ethylene oxide (54% aqueous solution), 2% of 80% acetic acid and 10% of anhydrous sodium sulphate. The liquor ratio is 1:12. After neutralisation with ammonia, the goods are then washed and dried. The woollen fabric is dyed in a brilliant, fast, red shade. The residual fat content of the dyed fabric is 0.4%, whereas that of the untreated fabric is 1%.

EXAMPLE 3

35 Parts of surfactant $A_1$, 25 parts of compound $B_1$, 15 parts of pine oil and 45 parts of water are mixed together at room temperature and the mixture is diluted with water to 1000 parts by volume.

A knitted polyacrylonitrile fabric is padded with this liquor and squeezed out to a pick-up of 80%. Without first rinsing and drying the fabric, it is subsequently dyed on a winchbeck for half an hour at 95° to 98° C. in a liquor which contains 0.8% of the dye of the formula

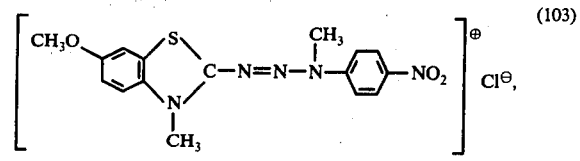

(103)

0.01% of the dye of the formula

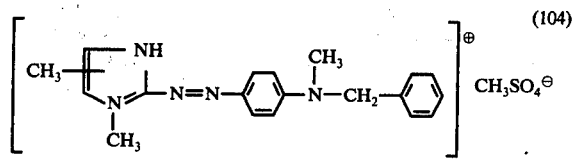

(104)

0.11% of the dye of the formula

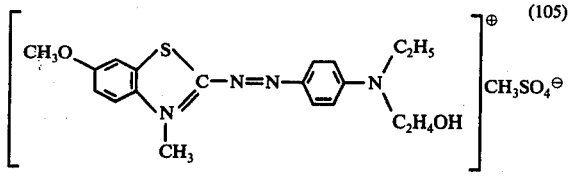

(105)

1% of 80% acetic acid, 5% of anhydrous sodium sulphate and 1/2% of a reaction product of 2 moles of dimethyl laurylamine and 1 mole of epichlorohydrin.

The dyed material is then thoroughly rinsed and dried. A fast, level, olive green dyeing is obtained.

Without the preliminary treatment the dyeing is unlevel and barry, a result which is attributable to deposits of preparations which accrue from the finishing of the yarns to improve the running properties (coating with paraffin) during the knitting procedure.

EXAMPLE 4

20 Parts of surfactant $A_1$, 4 parts of compound $B_1$, 5 parts of pine oil and 50 parts of water are mixed together at room temperature and the mixture is then diluted with water to 1000 parts by volume.

A knitted fabric of texturised polyamide (nylon 66), on which barry dyeing are normally obtained on account of differences in texturising, is padded with this liquor and squeezed out to a pick-up of 80%. After padding, the goods are stored for 1 hour with the exclusion of air. Without first rinsing them, the goods are then dyed at the boiling temperature of the liquor for 1½ hours in a jet dyeing machine. The liquor contains 2½% of the dye of the formula

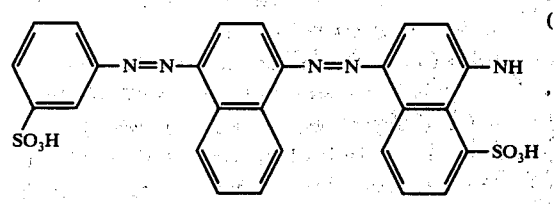

(106)

½% of an adduct of a fatty amine ($C_{18}$–$C_{22}$) and 30 moles of ethylene oxide, 4% of ammonium sulphate and 0.3% of 80% acetic acid.

A level, non-barry, blue dyeing of good fastness properties is obtained.

EXAMPLE 5

20 Parts of surfactant $A_1$, 10 parts of compound $B_1$, 10 parts of pine oil and 80 parts of water are mixed together at room temperature.

A soiled cotton fabric, stained with used motor oil, is given a localised preliminary cleaning with this mixture. After a storage time of 15 minutes, the fabric is dyed for 1 hour on a winchbeck without first being rinsed.

The liquor contains 6% of the dye of the formula

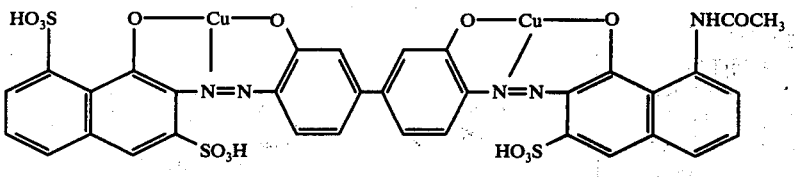

(107)

It is heated stepwise to 70° C., then to 90° C., and finally to boiling temperature, with 5% of sodium sulphate being added 5 times. After completion of the dyeing, the fabric is rinsed and, if appropriate, treated with a fixing agent, then dried. A level, stainless, blue dyeing is obtained.

Instead of the pretreatment described above, the fabric can also be padded as a whole and then stored before it is dyed on the winchbeck. There is less work involved in this latter procedure, but the consumption of chemicals is correspondingly greater.

If the preliminary treatment is not carried out, then the dyed fabric has distinct stains on it.

Stains are also evident after dyeing if the preliminary treatment has been carried out with a conventional stain removing agent, for example perchloroethylene.

EXAMPLE 6

100 kg of a blended fabric (55% polyester/45% wool), which has not been prewashed, are treated for 20 minutes at 60° C. on a closed winchbeck with radiant heating in an aqueous liquor of 4000 liters, which contains 6 kg of the preparation described hereinafter.

The preparation contains 30 parts of surfactant $A_1$, 15 parts of compound $B_1$, 15 parts of pine oil and 40 parts of water. Without first rinsing the fabric, the following ingredients are subsequently added to the liquor:

2000 g of the dyes of the formulae

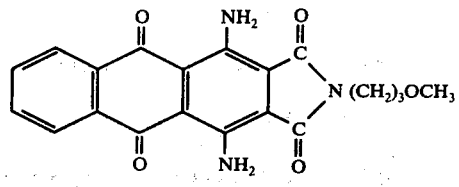

(108)

and

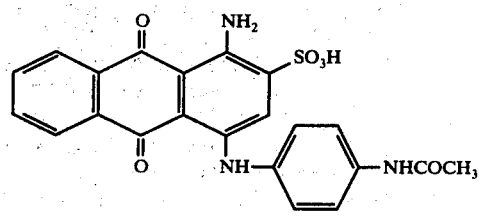

(109)

(mixture ratio 8:1), 12000 g of a 50% aqueous emulsion of o-phenylphenol, 300 g of a reaction product of 1 mole of a fatty amine ($C_{18}$–$C_{22}$) and 30 moles of ethylene oxide, quaternised with dimethyl sulphate (54% aqueous solution), 600 g of the ammonium salt of the acid sulphuric acid ester of the reaction product of 1 mole of a fatty amine ($C_{16}$–$C_{18}$) and 16 moles of ethylene oxide (54% aqueous solution), 1000 g of a condensation product of naphthalenesulphonic acid and formaldehyde, and dyeing is carried out for 2 hours at boiling temperature.

After rinsing and drying, a level blue dyeing is obtained, which, compared with a dyeing obtained without the above described pretreatment, is characterised by an improved tone-in-tone colouration and dye yield on the fabric.

EXAMPLE 7

A polyamide fabric (nylon 66), which has been soiled in parts by oil and other dirt stains (from loom oiling and greasing), is padded with the following liquor:

| | |
|---|---|
| 25 parts | of surfactant $A_1$ |
| 12 parts | of compound $B_1$ |
| 12 parts | of pine oil |
| 47 parts | of water |
| 96 parts | of preparation, bulked to 1000 parts with perchloroethylene. |

The fabric is then stored for 10 minutes with the exclusion of air and thereafter dyed for 45 minutes at 100° C. in a perchloroethylene liquor which contains 1% of the dye of the formula

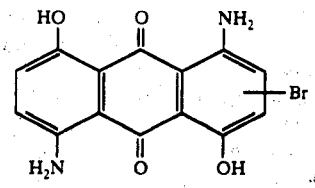

(110)

Instead of the above described padding application, the preparation can also be used for preliminary cleaning and the fabric then dyed in perchloroethylene without first being rinsed. A level, stainless, blue dyeing with good dye yield is obtained. Without the preliminary treatment the oily parts in the stains are removed in the dyebath; but carbon black, graphite and minerals remain, so that the goods have a stained appearance after they have been dyed.

EXAMPLE 8

100 kg of a blended fabric (polyester-cotton 67/33) are padded with a liquor which contains per liter 50 parts of a preparation consisting of
61 parts of surfactant $A_1$ (40% aqueous preparation)
13 parts of component $B_1$
13 parts of pine oil and
13 parts of water and
950 parts of water.

Instead of component $B_1$ it is also possible to use the same amount of components $B_2$, $B_3$, $B_4$ or $B_5$.

The liquor pick-up is 100%. After it has been padded, the fabric — without being rinsed beforehand — is wound onto a material carrier and dyed in a beam dyeing machine. The material is allowed to circulate initially at 60° C. for 10 minutes in a liquor which contains 1000 g of ammonium sulphate and is adjusted to a pH of approx. 5 to 6 with formic acid. The liquor ratio is 1:10. Then 800 g of the dye Vat Yellow 33 C.I. 65429 and of the dye of the formula

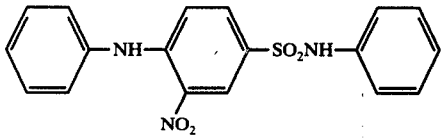

(111)

(mixture ratio 2:1) are added to the liquor, the temperature is raised to 125° C. in the course of 45 minutes and dyeing is then carried out for 60 minutes at this temperature. After the liquor has cooled to 80° C., 12 liters of a 40% aqueous solution of sodium hydroxide and 3000 g of sodium hydrogen sulphate are added and treatment is carried out for 45 minutes at this temperature. The liquor is then run off. Rinsing is performed in a fresh liquor (1000 liters), which contains 2 kg of sodium hydrogen carbonate, and treatment is carried out subsequently for 30 minutes at 50° C. in a further liquor (1000 liters) which contains 5 liters of 30% hydrogen peroxide. The fabric is then rinsed.

A fast, stainless, yellow dyeing is obtained. If dyeing is carried out without the described preliminary treatment, unlevel, stained dyeings of poor fastness to rubbing are obtained. To avoid such dyeings it was customary hitherto to prewash the fabric thoroughly. The pretreatment makes such a preliminary washing procedure redundant, whereby the amount of work involved and also the energy and water consumption can be substantially reduced.

Instead of the above preparation it is also possible to use preparations of the following composition:

50 parts of surfactant $A_{11}$ (40% aqueous preparation), 10 parts of component $B_1$, 10 parts of component $C_1$, $C_2$, $C_3$, $C_4$ or $C_{13}$ and 30 parts of water.

EXAMPLE 9

The badly soiled parts of worn shirts of blended fabric (polyester/cotton 67:33) are cleaned by rubbing in the following preparation:

| | |
|---|---|
| 70 parts | of surfactant $A_1$ (40% aqueous preparation) |
| 10 parts | of 2-ethyl hexanol |
| 10 parts | of compound $C_{10}$ |
| 10 parts | of water |
| 100 parts | . |

After the preparation has been allowed to act for 1 hour, the shirts are washed in a domestic washing machine at 60° C. with a conventional detergent. The soil release properties of the preparation render even the badly soiled parts of the shirts absolutely clean. Without the pretreatment with the above preparation, the shirts are not satisfactorily cleaned with a 60° C. warm wash.

With equally good success fabrics or piece goods of other fibrous materials, for example those of polyester, cotton, wool, polyamide, polyacrylonitrile, polypropylene or cellulose acetate or of other suitable blends of these fibres, can be given a preliminary cleaning and subsequently washed. Instead of component $C_{10}$ it is also possible to use components $C_9$, $C_{11}$, $C_{12}$, $C_{13}$, $C_{14}$ or $C_{15}$ in the same amounts to prepare the cleaning agent.

Preparations of the following composition can also be used for example as suitable cleaning agents:

(a)

54 parts of surfactant $A_1$ (40% aqueous preparation)
6 parts of compound $C_{13}$
8 parts of compound $C_{16}$
4 parts of compound $C_{17}$
28 parts of water (b)

61 parts of surfactant $A_1$ (40% aqueous preparation)
13 parts of component $B_1$
13 parts of pine oil
13 parts of water These liquid preparations can be converted into highly viscous pastes by adding approximately the same amount of water (80 to 100 parts).

We claim:

1. A stain removing composition, which consists essentially of (1) 20 to 30 percent by weight of an anionic surfactant of the formula

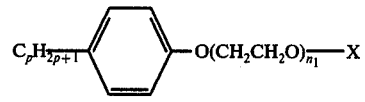

wherein $p$ is an integer from 8 to 12, $n_1$ is an integer of 1 to 50 and X is the acid radical of an inorganic acid which contains oxygen or the radical of a carboxylic acid, (2) 6 to 20 percent by weight of an aliphatic saturated or unsaturated, branched or straight-chain monoalcohol which contains 8 to 18 carbon atoms or a mixture of such alcohols, (3) 6 to 20 percent by weight of pine oil and (4) 40 to 68 percent by weight of water.

2. A composition according to claim 1 which contains 20 to 30 percent by weight of a compound of the formula

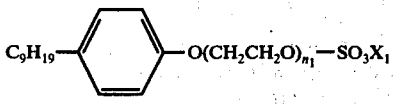

wherein $n_1$ is an integer from 1 to 50 and $X_1$ is hydrogen, $NH_4$ or an alkali metal cation, 6 to 20 percent by weight of an aliphatic saturated or unsaturated, branched or straight-chain monoalcohol which contains 8 to 18 carbon atoms or a mixture of such alcohols, 6 to 20 percent by weight of pine oil and 40 to 68 percent by weight of water.

3. A composition according to claim 2 which contains 20 to 30 percent by weight of the ammonium salt of the acid sulphuric acid ester of the adduct of 2 moles of ethylene oxide and 1 mole of p-tert. nonylphenol, 6 to 20 percent by weight of an aliphatic saturated or unsaturated, branched or straight-chain monoalcohol which contains 8 to 18 carbon atoms or a mixture of such alcohols, 6 to 20 percent by weight of pine oil and 40 to 68 percent by weight of water.

4. A composition, according to claim 3 which contains 20 to 30 percent by weight of the ammonium salt of the acid sulphuric acid ester of the adduct of 2 moles of ethylene oxide and 1 mole of p-tert. nonyl-phenol, 6 to 20 percent by weight of 2-ethylhexanol, 6 to 20 percent by weight of pine oil and 40 to 68 percent by weight of water.

5. A composition according to claim 1 wherein the monoalcohols of (2) contain 8 to 9 carton atoms.

* * * * *